US006830251B2

(12) United States Patent
Titzmann

(10) Patent No.: US 6,830,251 B2
(45) Date of Patent: Dec. 14, 2004

(54) ICE SKATE BLADE

(75) Inventor: Conrad Peter Titzmann, 12608 97th Avenue, Surrey British Columbia (CA), V3V 2E9

(73) Assignee: Conrad Peter Titzmann, Surrey (CA)

( * ) Notice: Subject to any disclaimer, the term of this patent is extended or adjusted under 35 U.S.C. 154(b) by 158 days.

(21) Appl. No.: 09/880,882

(22) Filed: Jun. 15, 2001

(65) Prior Publication Data

US 2001/0052678 A1 Dec. 20, 2001

(30) Foreign Application Priority Data

Jun. 19, 2000 (CA) ..... 2311951

(51) Int. Cl.[7] ..... A63C 1/32
(52) U.S. Cl. ..... 280/11.18; 280/11.12
(58) Field of Search ..... 280/11.18, 11.12, 280/28, 841

(56) References Cited

U.S. PATENT DOCUMENTS

| | | | | | |
|---|---|---|---|---|---|
| 44,115 | A | | 9/1864 | Race | |
| 77,862 | A | | 5/1868 | Barney et al. | |
| 83,339 | A | | 10/1868 | Thurston | |
| 187,697 | A | | 2/1877 | Adair | |
| 235,492 | A | | 12/1880 | Barney | |
| 524,129 | A | | 8/1894 | Bryant | |
| 803,269 | A | * | 10/1905 | Bryant | 280/11.18 |
| 1,181,831 | A | | 5/1916 | Browne | |
| 1,213,739 | A | | 1/1917 | Buork | |
| D50,943 | S | | 6/1917 | Hunold | |
| 1,749,298 | A | * | 3/1930 | Orafsik | 280/11.18 |
| 1,826,958 | A | * | 10/1931 | Sayer | 100/98 R |
| 1,886,650 | A | | 11/1932 | Davies et al. | |
| 2,150,964 | A | | 3/1939 | Dornseif | |
| 3,036,840 | A | | 5/1962 | Norgiel | |
| 4,392,658 | A | * | 7/1983 | Redmond et al. | 280/11.18 |
| 5,354,078 | A | * | 10/1994 | BelleIsle | 280/11.18 |
| 5,383,674 | A | * | 1/1995 | Cann et al. | 280/11.18 |
| 5,570,893 | A | * | 11/1996 | Swande | 280/11.18 |
| 5,826,890 | A | * | 10/1998 | Swande | 280/11.18 |

* cited by examiner

*Primary Examiner*—Christopher P. Ellis
*Assistant Examiner*—Brian L Swenson

(57) ABSTRACT

An ice skating blade has an upper portion having a top surface and two parallel substantially vertical left and right sides; and a lower portion having two faces flared outwardly from the upper portion, providing angled cutting edges. An appropriate angle of flare is 8° from the vertical.

8 Claims, 2 Drawing Sheets

ICE SKATE BLADE

TECHNICAL FIELD

This invention relates to ice skates, and more particularly to ice skate blades having a configuration which enhances skating performance.

BACKGROUND

A modem ice skate, such as an ice hockey skate, has a boot portion, a blade-holding system attached to the underside of the boot portion, and an ice-carving metal blade held by the blade-holding system. Typically, the metal blade is removable from the blade-holding system, allowing old, worn out blades to be replaced when necessary.

Skate blades have not changed much over the past number of decades. They are typically simply long, thin plates, having sharpened bottom edges for contacting the ice.

Blades for different types of skates may have different configurations. For example, the newest speed skating blades are very long, and flat. Hockey skate blades, on the other hand, are shorter, and may have a curvature, or a "rock" to them. This curvature decreases the amount of power a skater can transmit to the carving surface (the ice), since it decreases the portion of the blade touching the ice at any one time, but it also increases the skater's mobility and manoeuverability. It is this aspect of skate blades which has been experimented with and developed most recently by others. There has been little development of other aspects of blades.

U.S. Pat. No. 3,036,840, which issued to L. I. Norgiel on May 29, 1962, shows a skate blade similar in some aspects to the one which is the subject of the present invention. The similarity lies in the flare of the very bottom portion of the blade, as shown in FIG. 5 of that patent. However, the blade shown in the Norgiel patent has many shortcomings which preclude its use in modem hockey skates. For one, it is wider in the middle of the blade, and narrow at the ends. This configuration, while perhaps suitable for figure skating blades, is not preferred for hockey skate blades. Second, the blade does not have a consistent angle of flare over its entire length. It furthermore cannot be easily machined, but rather, is only easily constructed by forging, which is possible only with materials of lesser hardness than preferable to maintain a sharp edge.

SUMMARY OF INVENTION

The present invention provides an ice skate blade offering enhanced skating performance. The blade has an upper portion comprising two parallel substantially vertical left and right sides and a lower portion comprising two lower faces, each lower face extending downwardly and outwardly from the bottom of one of the sides at an angle of between 4° and 12° from the vertical. The lower faces having lower edges bounding between them the bottom surface of the blade. The bottom surface is preferably concave.

In a preferred embodiment, the upper faces have a width between them of 3 mm, and the lower edges are parallel and have a width between them of between 4 mm and 5 mm. Most preferably, the lower faces extend outwardly at an angle of 8° from the vertical.

The skate blade of the preferred embodiment also comprises means for attaching the blade to an ice skate.

DESCRIPTION OF DRAWINGS

In drawings which illustrate a specific embodiment of the invention, but which should not be construed as restricting the spirit or scope of the invention in any way.

DESCRIPTION

Figure 1:
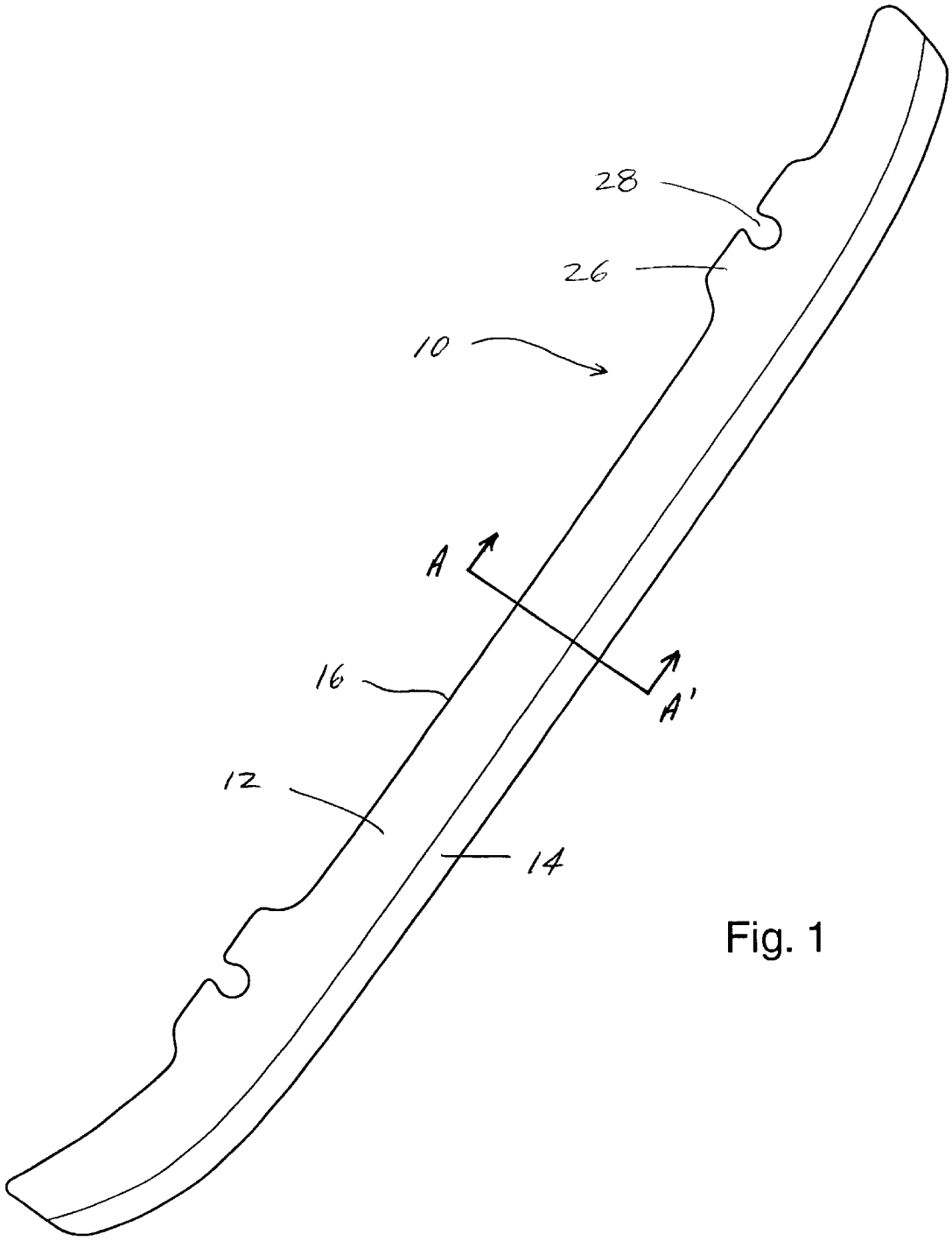
FIG. 1 is a side view of the ice skate blade of the present invention.

Referring to FIG. 1, an ice skate blade made in accordance with one embodiment of the invention, denoted generally by the numeral 10, has, generally, an upper portion 12 and a lower portion 14.

Figure 2A:
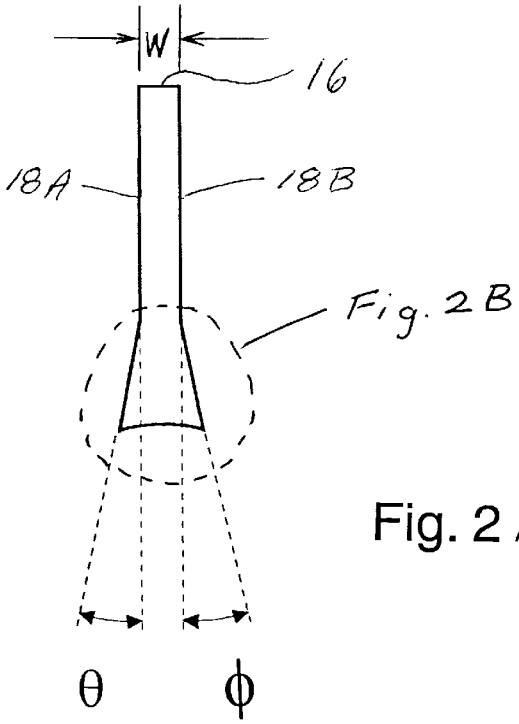
FIG. 2A is a cross sectional view of the skate blade shown in FIG. 1, along line A–A$^1$.

Upper portion 12 has a top surface 16 and a left side 18A and a right side 18B extending downwardly from top surface 16 (FIG. 2A). Left and right sides 18A, 18B are substantially vertical and are in parallel arrangement in a preferred embodiment of the invention.

Figure 2B:
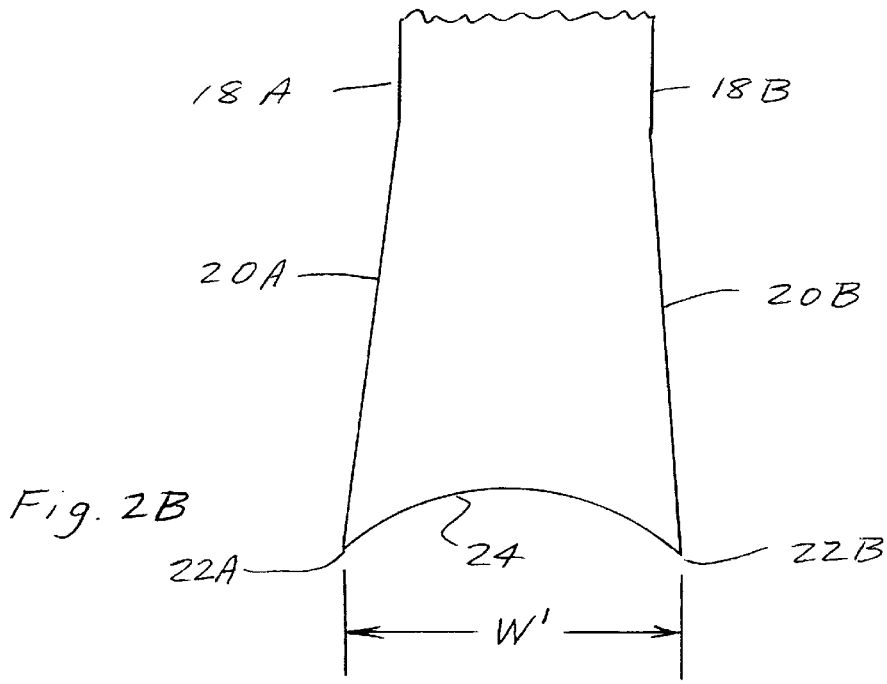
FIG. 2B is a close-up view of the bottom portion of the cross-section of the blade shown in FIG. 2A.

Lower portion 14 of skate blade 10 has two faces 20A, 20B (FIG. 2B), each one extending downwardly and outwardly from the bottom of one of sides 18A, 18B.

The inventor of the present invention has discovered that blade 10 lends particular advantage to a skater when face 20A extends outwardly from side 18A at an angle $\theta$, and face 20B extends outwardly from side 18B at an angle $\phi$, where angles $\theta$, $\phi$ are between 4° and 12° from the vertical, as shown in FIG. 2A. FIG. 2A is a cross sectional view of the blade of FIG. 1.

Angles $\theta$, $\phi$ may be identical, but need not be. For particular applications, it is favourable that the angles $\theta$, $\phi$ are different. However, in a preferred embodiment, angles $\theta$, $\phi$ are identical, and are 8°.

Lower faces 20A, 20B having lower ice-carving edges 22A, 22B, which bound between them the bottom surface 24 of the blade 10. It will be appreciated that edges 22A and 22B are parallel, just as sides 18A and 18B are parallel. In a preferred embodiment, bottom surface 24 is concave in configuration.

It is important to note that the main feature of the present invention, namely, the angled nature of the bottom portion 14 of blade 10, can be accomplished by constructing the upper portion 12 of blade 10 such that it has a width W of approximately 3 mm (FIG. 2A), and by constructing the lower portion 14 of blade 10 such that it has a bottom width W$^1$ of between 4 mm and 5 mm. When so constructed, lower portion 14 occupies approximately one-third of the height of blade 10 (not including any mounting means for blade 10), as seen in FIG. 1. Lower portion 14 also extends along the entire bottom length of blade 10.

It will be further appreciated that the blade of the current invention may be constructed of any suitable material. However, the inventor of the present invention has found in practice that the use of #304 stainless steel allows for efficient machining of the blade, and also provides useful properties to the finished blade itself For example, it will be appreciated that as the blade 10 is sharpened, width W$^1$ will decrease. Since the effectiveness of the blade is dependent upon the spacial relationship between this bottom width W$^1$ and the preferred angles of the lower faces 20A, 20B, it is important that the material of the blade be hard enough not to require frequent sharpenings.

While a variety of mounting means can be implemented to mount blade 10 into a blade-holding system incorporated into a skate, in the presently-preferred art blades are typically attached by means of one or more bolts being fastened into cavities formed within the blades. Accordingly, the present blade may be constructed to have mounting means comprising one or more tabs 26 formed at the top of the upper portion 12 of blade 10 (as shown in FIG. 1), each tab 26 having a cavity 28 for accepting a bolt from the blade-holding system. In the alternative, cavities may be formed through the upper portion 12 itself, to accommodate another popular mounting system wherein bolts run laterally through blade 10.

As will be apparent to those skilled in the art in the light of the foregoing disclosure, many alterations and modifications are possible in the practice of this invention without departing from the spirit or scope thereof. For example, as previously mentioned, while the skate of the preferred embodiment is preferably constructed of #304 stainless steel, other materials may be suitably employed. Accordingly, the scope of the invention is to be construed in accordance with the substance defined by the following claims.

What is claimed is:

1. An ice skate blade comprising:

a) an upper portion having a top surface and two linear left and right sides forming two substantially parallel planar blade mounting surfaces; and b) a lower portion comprising two planar lower faces, each lower face extending linearly downwardly and outwardly from the bottom of one of said sides at a discrete angle of between 4° and 12° , said lower faces having lower edges bounding between them the bottom surface of said blade.

2. An ice skate blade as claimed in claim 1, wherein said lower edges are parallel and have a width between them of between 4 mm and 5 mm.

3. An ice skate blade as claimed in claim 2 wherein said lower faces extend outwardly at the same angle.

4. An ice skate blade as claimed in claim 3 wherein said lower faces extend outwardly at an angle of 8° from said bottom of said sides, respectively.

5. An ice skate blade as claimed in claim 4 wherein said sides have a width between them of 3 mm.

6. An ice skate blade as claimed in claim 5 further comprising means for attaching said blade to an ice skate.

7. An ice skate blade as claimed in claim 6 wherein said bottom surface is concave.

8. An ice skate blade as claimed in claim 7 wherein said blade is constructed of #304 stainless steel.

* * * * *